US009009051B2

(12) United States Patent
Fume et al.

(10) Patent No.: US 9,009,051 B2
(45) Date of Patent: Apr. 14, 2015

(54) APPARATUS, METHOD, AND PROGRAM FOR READING ALOUD DOCUMENTS BASED UPON A CALCULATED WORD PRESENTATION ORDER

(75) Inventors: Kosei Fume, Kawasaki (JP); Masaru Suzuki, Kawasaki (JP); Yuji Shimizu, Kawasaki (JP); Tatsuya Izuha, Kawasaki (JP)

(73) Assignee: Kabushiki Kaisha Toshiba, Minato-ku, Tokyo (JP)

( * ) Notice: Subject to any disclaimer, the term of this patent is extended or adjusted under 35 U.S.C. 154(b) by 1058 days.

(21) Appl. No.: 13/053,976

(22) Filed: Mar. 22, 2011

(65) Prior Publication Data

US 2012/0078633 A1 Mar. 29, 2012

(30) Foreign Application Priority Data

Sep. 29, 2010 (JP) ..... 2010-219777

(51) Int. Cl.
*G10L 13/027* (2013.01)
*G10L 13/08* (2013.01)

(52) U.S. Cl.
CPC ..... *G10L 13/08* (2013.01); *G10L 13/027* (2013.01)

(58) Field of Classification Search
CPC ..... G10L 13/08; G10L 13/027
USPC ..... 704/9, 258, 259, 260; 434/317
See application file for complete search history.

(56) References Cited

U.S. PATENT DOCUMENTS

| | | | | |
|---|---|---|---|---|
| 6,384,743 | B1 * | 5/2002 | Vanderheiden | 341/21 |
| 2004/0023193 | A1 * | 2/2004 | Wen et al. | 434/167 |
| 2006/0190260 | A1 * | 8/2006 | Iso-Sipila | 704/258 |
| 2008/0091706 | A1 | 4/2008 | Suzuki et al. | 707/102 |
| 2008/0140401 | A1 * | 6/2008 | Abrash et al. | 704/251 |
| 2008/0215550 | A1 | 9/2008 | Fume et al. | 707/3 |
| 2009/0018836 | A1 * | 1/2009 | Morita et al. | 704/260 |
| 2009/0220926 | A1 * | 9/2009 | Rechlis | 434/185 |
| 2009/0313020 | A1 * | 12/2009 | Koivunen | 704/260 |
| 2011/0264452 | A1 * | 10/2011 | Venkataramu et al. | 704/260 |

FOREIGN PATENT DOCUMENTS

| | | |
|---|---|---|
| JP | 11-075541 | 3/1999 |
| JP | 2000-267687 | 9/2000 |
| JP | 2001-341143 | 12/2001 |
| JP | 2003-140679 | 5/2003 |

* cited by examiner

*Primary Examiner* — James Wozniak
(74) *Attorney, Agent, or Firm* — Ohlandt, Greeley, Ruggiero & Perle, L.L.P.

(57) ABSTRACT

According to one embodiment, a reading aloud support apparatus includes a reception unit, a first extraction unit, a second extraction unit, an acquisition unit, a generation unit, a presentation unit. The reception unit is configured to receive an instruction. The first extraction unit is configured to extract, as a partial document, a part of a document which corresponds to a range of words. The second extraction unit is configured to perform morphological analysis and to extract words as candidate words. The acquisition unit is configured to acquire attribute information items relates to the candidate words. The generation unit is configured to perform weighting relating to a value corresponding a distance and to determine each of candidate words to be preferentially presented to generate a presentation order. The presentation unit is configured to present the candidate words and the attribute information items in accordance with the presentation order.

8 Claims, 14 Drawing Sheets

湾岸線に入ると雨脚は一層ひどくなった。リアが遮光された車高調入りの車内

で三枝は社内にいたときとは別人のように、車載モニタでACARSの描き出す航
↑(B)
跡がまた一つ現れては消えていくのを見つめていた。
↑(A)

*(Wangan sen ni hairu to amaashi wa isso hidoku na ta . ria ga shako sa re ta sha kocho iri no shanai de saegusa wa shanai ni i ta toki to wa betsujin no yo ni , shasai monita de ACARS no egakidasu koseki ga mata hitotsu arawarete wa kie te iku no wo mitsume te ita. )*

(When the car turned onto the Wangan Expressway, the rain got heavier still. In the car, with its tinted rear window and ride height control, Saegusa was watching airplane tracks appearing and then disappearing one after another on the ACARS in-car monitor; he looked different from the way he had been at the office.)

FIG. 2

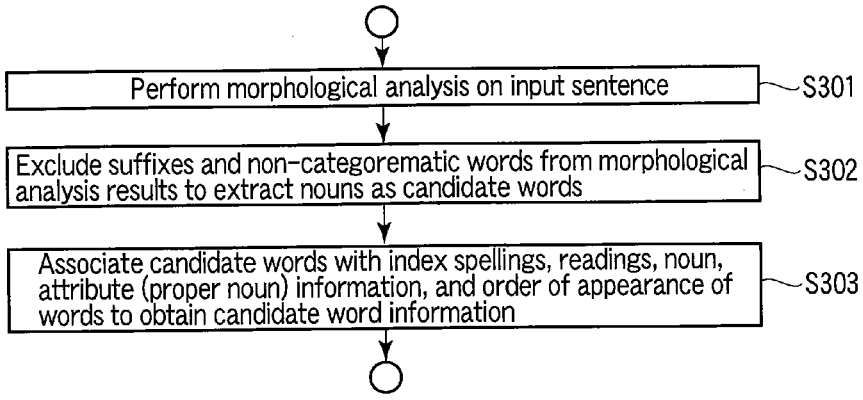

FIG. 3

| 401 | | 402 |
|---|---|---|
| 湾岸 | (wangan) | Noun, common,*,*,*,*, wangan, wangan, wangan |
| 線 | (sen) | Noun, suffix, common,*,*,*, sen, sen, sen |
| に | (ni) | Particle, case particle, common,*,*,*, ni, ni, ni |
| 入る | (hairu) | Verb, categorematic,*,*, godan verb, verb ending with "ru", plain form, hairu, hairu, hairu |
| と | (to) | Particle, conjunctive particle,*,*,*,*, to, to, to |
| 雨脚 | (amaashi) | Noun, common,*,*,*,*, amaashi, amaashi, amaashi |
| は | (wa) | Particle, binding particle,*,*,*,*, ha, ha, wa |
| 一層 | (isso) | Adverb, particles conjunction,*,*,*,*, isso, issou, isso |
| ひどく | (hidoku) | Adjective, categorematic,*,*, adjective・auo,continuative te conjunction, hidoi, hidoku, hidoku |
| なっ | (na) | Verb, categorematic,*,*, godan verb, verb ending with "ru", continuative ta conjunction, naru, na, na |
| た | (ta) | Auxiliary verb,*,*,*, special・ta, plain form, ta, ta, ta |
| 。 | | Symbol, point,*,*,*,*,。,。,。 |

FIG. 4A

| 401 | 402 |
|---|---|
| リア (ria) | Noun, common, *, *, *, *, ria, ria, ria |
| が (ga) | Particle, case particle, common, *, *, *, ga, ga, ga |
| 遮光 (shako) | Noun, irregular conjunction of "suru" verb, *, *, *, *, shako, shako, shako |
| さ (sa) | Verb, categorematic, *, * irregular conjunction of "suru" verb, imperfective conjunction of "reru" verb, suru, sa, sa |
| れ (re) | Verb, suffix, *, *, ichidan verb, continuative form, reru, re, re |
| た (ta) | Verbal auxiliary, *, *, *, special・ta, plain form, ta, ta, ta |
| 車 (sha) | Noun, common, *, *, *, *, sha, kuruma, kuruma |
| 高調 (kocho) | Noun, irregular conjunction of "suru" verb, *, *, *, *, kocho, kocho, kocho |
| 入り (iri) | Noun, suffix, irregular conjunction of "suru" verb *, *, *, iri, iri, iri |
| の (no) | Particle, adnominalization, *, *, *, *, no, no, no |
| 車内 (shanai) | Noun, common, *, *, *, *, shanai, shanai, shanai |
| で (de) | Particle, case particle, common, *, *, *, de, de, de |
| 三枝 (saegusa) | Noun, proper noun, personal name, family name, *, *, saegusa, saegusa, saegusa |
| は (wa) | Particle, binding particle, *, *, *, *, ha, ha, wa |
| 社内 (shanai) | Noun, common, *, *, *, *, shanai, shanai, shanai |
| に (ni) | Particle, case particle, common, *, *, *, ni, ni, ni |
| い (i) | Verb, categorematic, *, *, ichidan verb, continuative form, iru, i, i |
| た (ta) | Verbal auxiliary, *, *, *, special・ta, plain form, ta, ta, ta |
| とき (toki) | Noun, non-categorematic, adverb potential, *, *, *, toki, toki, toki |
| と (to) | Particle, case particle, quotation, *, *, *, to, to, to |
| は (wa) | Particle, binding particle, *, *, *, *, ha, ha, wa |
| 別人 (betsujin) | Noun, common, *, *, *, *, betsujin, betsujin, betsujin |
| の (no) | Particle, adnominalization, *, *, *, *, no, no, no |
| よう (yo) | Noun, non-categorematic, verbal auxiliary stem, *, *, *, yo, yo, yo |
| に (ni) | Particle, adverbalization, *, *, *, *, ni, ni, ni |
| 、 | Symbol, point, *, *, *, *, 、, 、, 、 |

FIG. 4B

| 401 | | 402 |
|---|---|---|
| 車載 | (shasai) | Noun, irregular conjunction of "suru" verb, *, *, *, *, shasai, shasai, shasai |
| モニタ | (monita) | Noun, irregular conjunction of "suru" verb, *, *, *, *, monita, monita, monita |
| で | (de) | Particle, case particle, common, *, *, *, de, de, de |
| ACARS | | Noun, common, *, *, *, *, * |
| の | (no) | Particle, case particle, common, *, *, *, no, no, no |
| 描き出す | (egakidasu) | Verb, categorematic, *, *, godan verb, "suru" verb, plain form, egakidasu, egakidasu, egakidasu |
| 航跡 | (koseki) | Noun, common, *, *, *, *, koseki, koseki, koseki |
| が | (ga) | Particle, case particle, common, *, *, *, ga, ga, ga |
| また | (mata) | Conjunction, *, *, *, *, *, mata, mata, mata |
| 一つ | (hitotsu) | Noun, common, *, *, *, *, hitotsu, hitotsu, hitotsu |
| 現れ | (araware) | Verb, categorematic, *, *, ichidan verb, continuative form, arawareru, araware, araware |
| て | (te) | Particle, conjunctive particle, *, *, *, *, te, te, te |
| は | (wa) | Particle, binding particle, *, *, *, *, ha, ha, wa |
| 消え | (kie) | Verb, categorematic, *, *, ichidan verb, continuative form, kieru, kie, kie |
| て | (te) | Particle, conjunctive particle, *, *, *, *, te, te, te |
| いく | (iku) | Verb, non-categorematic, *, *, godan verb, "kuru" verb with nasal sound change, plain form, iku, iku, iku |
| の | (no) | Noun, non-categorematic, common, *, *, *, no, no, no |
| を | (wo) | Particle, case particle, common, *, *, *, wo, wo, wo |
| 見つめ | (mitsume) | Verb, categorematic, *, *, ichidan verb, continuative form, mitsumeru, mitsume, mitsume |
| て | (te) | Particle, conjunctive particle, *, *, *, *, te, te, te |
| い | (i) | Verb, non-categorematic, *, *, ichidan verb, continuative form, iru, i, i |
| た | (ta) | Verbal auxiliary, *, *, *, special・ta, plain form, ta, ta, ta |
| 。 | | Symbol, comma, *, *, *, *, 。, 。, 。 |

FIG. 4C 501 502 503 504

| ID | Spelling | Morphological analysis results |
|---|---|---|
| (1) | 湾岸 (wangan) | noun, common, wangan |
| (2) | 雨脚 (amaashi) | noun, common, amaashi |
| (3) | リア (ria) | noun, common, ria |
| (4) | 遮光 (shako) | noun, irregular conjunction of "suru" verb, shako |
| (5) | 車 (sha) | noun, common, kuruma |
| (6) | 高調 (kocho) | noun, irregular conjunction of "suru" verb, kocho |
| (7) | 車内 (shanai) | noun, common, shanai |
| (8) | 三枝 (saegusa) | noun, proper noun, saegusa |
| (9) | 社内 (shanai) | noun, common, shanai |
| (10) | 別人 (betsujin) | noun, common, betsujin |
| (11) | 車載 (shasai) | noun, irregular conjunction of "suru" verb, shasai |
| (12) | モニタ(monita) | noun, irregular conjunction of "suru" verb, monita |
| (13) | ACARS | noun, common, |
| (14) | 航跡 (koseki) | noun, common, koseki |
| (15) | 一つ (hitotsu) | noun, common, hitotsu |

FIG. 5

501 502 503 701 702 703 704 705 707

| ID | Spelling | Morphological analysis results | High concate-nation cost | List of other readings | List of homophones | Internal indices or internal dictionary | External dictionary |
|---|---|---|---|---|---|---|---|
| (1) | 湾岸 *(wangan)* | noun, common, wangan | | irie/kishi | – | – | – |
| (2) | 雨脚 *(amaashi)* | noun, common, amaashi | | ame/kyaku | – | – | – |
| (3) | リア *(ria)* | noun, common, ria | | – | – | – | – |
| (4) | 遮光 *(shako)* | noun, irregular conjunction of "suru" verb, shako | | sagiru/hikari | shako/shako | – | – |
| (5) | 車 *(sha)* | noun, common, kuruma | * | sha | – | – | – |
| (6) | 高調 *(kocho)* | noun, irregular conjunction of "suru" verb, kocho | * | takai/shiraberu | – | – | – |
| (7) | 車内 *(shanai)* | noun, common, shanai | | kuruma/uchi | – | – | – |
| (8) | 三枝 *(saegusa)* | noun, proper noun, saegusa | | mie; sanshi; mittsu/eda | – | sakuma mie | yatsura sanshi/saegusa haruka |
| (9) | 社内 *(shanai)* | noun, common, shanai | | yashiro/uchi | shanai | – | – |
| (10) | 別人 *(betsujin)* | noun, common, betsujin | | wakare/hito | – | – | – |
| (11) | 車載 *(shanai)* | noun, irregular conjunction of "suru" verb, shasai | | kuruma/noseru | shasai | – | – |
| (12) | モニタ *(monita)* | noun, irregular conjunction of "suru" verb, monita | | – | – | – | – |
| (13) | ACARS | noun, common, | | A/C/A/R/S | – | – | Aircraft Communications Addressing and Reporting System |
| (14) | 航跡 *(koseki)* | noun, common, koseki | | wataru/ato | koseki | – | – |
| (15) | 一つ *(hitotsu)* | noun, common, hitotsu | | ichi | – | – | – |

504 706

FIG. 7

APPARATUS, METHOD, AND PROGRAM FOR READING ALOUD DOCUMENTS BASED UPON A CALCULATED WORD PRESENTATION ORDER

CROSS-REFERENCE TO RELATED APPLICATIONS

This application is based upon and claims the benefit of priority from Japanese Patent Application No. 2010-219777, filed Sep. 29, 2010; the entire contents of which are incorporated herein by reference.

FIELD

Embodiments described herein relate generally to a reading aloud support apparatus, method and program.

BACKGROUND

In recent years, with the prevalence of computerization of books (electronic books), electronic books have been browsed on PCs, mobile terminals, or terminals for electronic books, and a speech synthesis system (Text-to-Speech [TTS]) has been used to recite content text to provide a recitation voice listened to by users. When the text is recited to provide a recitation voice listened to by users, any text can be read aloud, and so the recitation voice can be easily obtained without the need to prepare a recitation voice for each content item. However, synthesized voice outputs may involve misreading, errors in accents, words that are difficult to understand only by sound, or homophones. Thus, users need to instruct the system to go backward through the voice recitation being continuously reproduced, by an amount corresponding to a given time or to specify a reproduction start point on a screen user interface (UI) to allow re-reading to be carried out.

However, when re-reading aloud is carried out from any point during the reading aloud, the user needs to carefully listen to candidate words for re-reading being read aloud in an order reverse to the time series, while specifying a desired start position. Furthermore, even if candidate words for re-reading are limited using prosodic boundaries or segment delimiters of a particular type as clues, output voices resulting from the re-reading aloud have the same contents as those of the last reading aloud except for preregistered synonyms. This means that the listener listens to read aloud contents with erroneous or obscure again. Hence, the listener still fails to understand the document.

BRIEF DESCRIPTION OF THE DRAWINGS

FIG. 2 illustrates an example of a partial document extracted by a partial document extraction unit.

FIG. 3 is a flowchart illustrating the operation of a phrase extraction unit.

FIG. 4A illustrates an example of results of morphological analysis performed by the phrase extraction unit.

FIG. 4B illustrates an example of the results of the morphological analysis performed by the phrase extraction unit.

FIG. 4C illustrates an example of the results of the morphological analysis performed by the phrase extraction unit.

FIG. 5 illustrates an example of candidate word information items extracted by the phrase extraction unit.

FIG. 7 illustrates an example of candidate word information items and corresponding detailed attributes.

DETAILED DESCRIPTION

Figure 1:
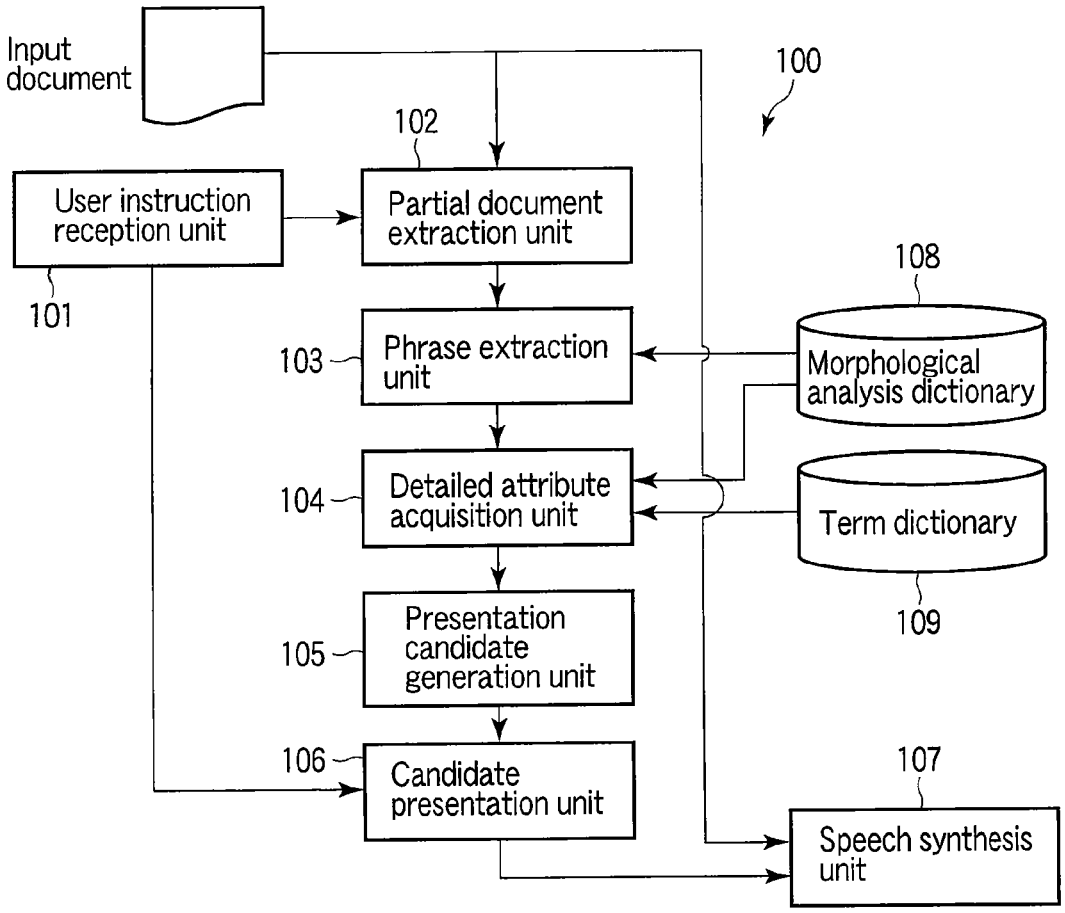
FIG. 1 is a block diagram illustrating a reading aloud support apparatus according to the present embodiment.

In general, according to one embodiment, a reading aloud support apparatus includes a reception unit, a first extraction unit, a second extraction unit, an acquisition unit, a generation unit, a presentation unit. The reception unit is configured to receive an instruction from a user to generate an instruction signal. The first extraction unit is configured to extract, as a partial document, a part of the document which corresponds to a range of words including a first word and one or more second words preceding the first word, if the instruction signal is received while the speech synthesis device performs to read aloud the first word of the document. The second extraction unit is configured to perform morphological analysis on a sentence included in the partial document and to extract one or more words as one or more candidate words, the candidate words which belong to a word class corresponding to target start positions for re-reading of the partial document. The acquisition unit is configured to acquire, for each of the candidate words, attribute information items relating to the candidate words, the attribute information items including reading candidates. The generation unit is configured to perform, for each of the candidate words, weighting relating to a value corresponding a distance, the distance indicating a number of characters between each of the candidate words and the first word, to determine each of the candidate words to be preferentially presented based on the weighting, and to generate a presentation order. The presentation unit is configured to present the candidate words and the attribute information items corresponding to the candidate words in accordance with the presentation order.

A description will now be given of a reading aloud support apparatus, method and program according to the present embodiment with reference to the accompanying drawings. In the embodiment described below, the same reference numerals will be used to denote similar-operation elements, and a repetitive description of such elements will be omitted.

A reading aloud support apparatus according to the first embodiment will be described with reference to FIG. 1.

The reading aloud support apparatus 100 according to the present embodiment includes a user instruction reception unit 101, a partial document extraction unit 102, a phrase extraction unit 103, a detailed attribute acquisition unit 104, a presentation candidate generation unit 105, a candidate presentation unit 106, a speech synthesis unit 107, a morphological analysis dictionary 108, and a term dictionary 109. In the present embodiment, it is assumed that the speech synthesis unit 107 outputs, as voices, character strings in an externally provided document (hereinafter referred to as an input document) to be automatically read aloud. However, the reading aloud support apparatus may support an external speech synthesis apparatus.

The user instruction reception apparatus 101 receives an instruction from a user to generate an instruction signal. The user inputs an instruction, for example, to instruct the apparatus to re-read a document while voices corresponding to the document are being output or to specify a word corresponding to a re-read start position. An instruction is also input, for example, to change the word or attribute information items or to correct the reading aloud in a voice. Furthermore, as a technique for allowing the user instruction reception unit 101 to receive an instruction from the user, for example, the user may press a remote control button attached to an earphone or operate a particular button on a terminal. Alternatively, if the terminal includes a built-in acceleration sensor or the like, the user may shake the terminal or tap a screen or the like. However, the present embodiment is not limited to these techniques. Any method may be used provided that the method allows the user instruction reception unit 101 to be noticed of reception of an instruction.

The partial document extraction unit 102 receives a document (hereinafter referred to as an input document) to be automatically read aloud, from an external source, and receives the instruction signal from the user instruction reception unit 101. The partial document extraction unit 102 extracts, as a partial document, a part of the document which corresponds to a certain range of words including one being read aloud at the time of the reception of the instruction signal and those which precede and follow this word. The partial document will be described below with reference to FIG. 2.

The phrase extraction unit 103 receives the partial document from the partial document extraction unit 102, performs a morphological analysis on the partial document with reference to the morphological analysis dictionary 108, and extracts a word that is a word class corresponding to a target start position for re-reading of the document. The phrase extraction unit 103 obtains candidate word information items including candidate words and associated information items resulting from the morphological analysis of the candidate words. The information resulting form morphological analysis of the candidate words referred to as morphological analysis information. The operation of the phrase extraction unit 103 will be described below with reference to FIG. 4 and FIG. 5.

The detailed attribute acquisition unit 104 receives the candidate word information items from the phrase extraction unit 103, acquires, for each of the candidate word information items, attribute information items indicating information on the candidate word with reference to the morphological analysis dictionary 108 and the term dictionary 109, and obtains detailed attribute information items including candidate word information items and attribute information items associated with each other. The attribute information items are, for example, other reading candidates for the candidate words and homophones. The operation of the detailed attribute acquisition unit 104 will be described below with reference to FIG. 6 and FIG. 7.

The presentation candidate generation unit 105 receives the detailed attribute information items from the detailed attribute acquisition unit 104 to generate a presentation order indicative of the order of the candidate words to be presented. The operation of the presentation candidate generation unit 105 will be described below with reference to FIG. 8 to FIG. 10.

The candidate presentation unit 106 receives the presentation order and the detailed attribute information items from the presentation candidate generation unit 105 to present the candidate words and the attribute information items on the candidate words in accordance with the presentation order. Furthermore, if the candidate presentation unit 106 receives an instruction signal from the user instruction reception unit 101, the candidate presentation unit 106 presents other candidate words.

The speech synthesis unit 107 receives the input document from the external source and outputs character strings in the document as voices to read aloud the document. The speech synthesis unit 107 also receives the candidate words and the attribute information items on the candidate words from the candidate presentation unit 106, converts the candidate words into voice information, and outputs the voice information to the exterior as voices.

The morphological analysis dictionary 108 stores data to perform morphological analysis.

The term dictionary 109 is, for example, a data repository. The term dictionary 109 stores a Japanese dictionary, a technical term dictionary, ontology-based information, or encyclopedic information which is accessible. However, the present embodiment is not limited to these dictionaries.

For each of the morphological analysis dictionary 108 and the term dictionary 109, required information may be appropriately acquired from the web via a network with reference to an externally provided dictionary. Alternatively, the phrase extraction unit 103 and the detailed attribute acquisition unit 104 may include the morphological analysis dictionary 108 and the term dictionary 109, respectively.

An example of a partial document extracted by the partial document extraction unit 102 will be described with reference to FIG. 2.

An object to be extracted as a partial document may be a sentence including a word being read aloud at the time of inputting of an instruction by the user, a sentence preceding a sentence including the word being read aloud at the time of inputting, a sentence read aloud during a set period, or a combination thereof. Moreover, if the user gives an instruction in the middle of a sentence, the partial document may be from the beginning to end of the sentence, that is, may include a part of the sentence which has not been read aloud yet. In the example illustrated in FIG. 2, the partial document is a sentence being read aloud when the partial document extraction unit 102 receives an instruction signal from the user instruction reception unit 101 and a sentence preceding this sentence being read aloud at the time of the reception. Here, it is assumed that an instruction signal from the user is received at time (A) shown in FIG. 2.

The operation of the phrase extraction unit 103 will be described with reference to a flowchart in FIG. 3.

In step S301, the phrase extraction unit 103 receives the partial document from the partial document extraction unit 102 and performs a morphological analysis on the partial document.

In step S302, the phrase extraction unit 130 excludes suffixes and non-categorematic words from the results of the morphological analysis and extracts nouns from the results as candidate words. In the present embodiment, the suffixes and non-categorematic words are excluded, and the nouns are extracted. However, the present embodiment is not limited to this aspect, and adjectives or verbs may be extracted. Furthermore, a character type may be noted, and if an alphabetical word or a numerical expression appears, the word or the numerical expression may be extracted.

In step S303, the phrase extraction unit 103 obtains candidate word information items by associating the candidate words extracted in step S302 with information items such as corresponding index spellings, readings, noun, attribute (proper noun) information, and appearance order.

FIG. 4A, FIG. 4B and FIG. 4C show the results of the morphological analysis. FIG. 4A to FIG. 4C show the results of morphological analysis of the partial document in FIG. 2. Column 401 is surface layer expressions corresponding to word class into which a partial document is divided. A column 402 is morphological analysis information corresponding to the word class. The morphological analysis information includes the name of word class, reading, and an inflected form and so on. "*" indicates that the corresponding word class has no information.

Now, the candidate words and morphological analysis information extracted in step S302 will be described with reference to FIG. 5.

In the results of the morphological analysis in FIG. 4A to FIG. 4C, a word class for which the name of word class included in the detailed information item in the column 402 is a "noun" are extracted as candidate words. Specifically, in FIG. 4A, "湾岸 (wangan) (coast)" and "雨脚 (amaashi) (rain)" are extracted as candidate words. In FIG. 4B, "リア (ria) (rear)" and "遮光 (shako) (tinted)" are extracted as candidate words. Furthermore, the morphological analysis information corresponding to the extracted candidate words is extracted. Combinations of the candidates and the morphological analysis information are stored as candidate word information items. ID 501 indicates the order of the candidate words extracted starting from the first word of the partial document, that is, the order in which the candidate words appear. Spelling 502 indicates the spellings of the candidate words extracted from the column 401 in FIG. 4. Morphological analysis results 503 indicate detailed information items corresponding to the nouns. Here, a noun name, a noun type, and reading are stored. However, the present embodiment is not limited to these pieces of detailed information items. As described above, ID 501, the spelling 502, and the morphological analysis results 503 are associated with one another as candidate word information items 504.

Figure 6:
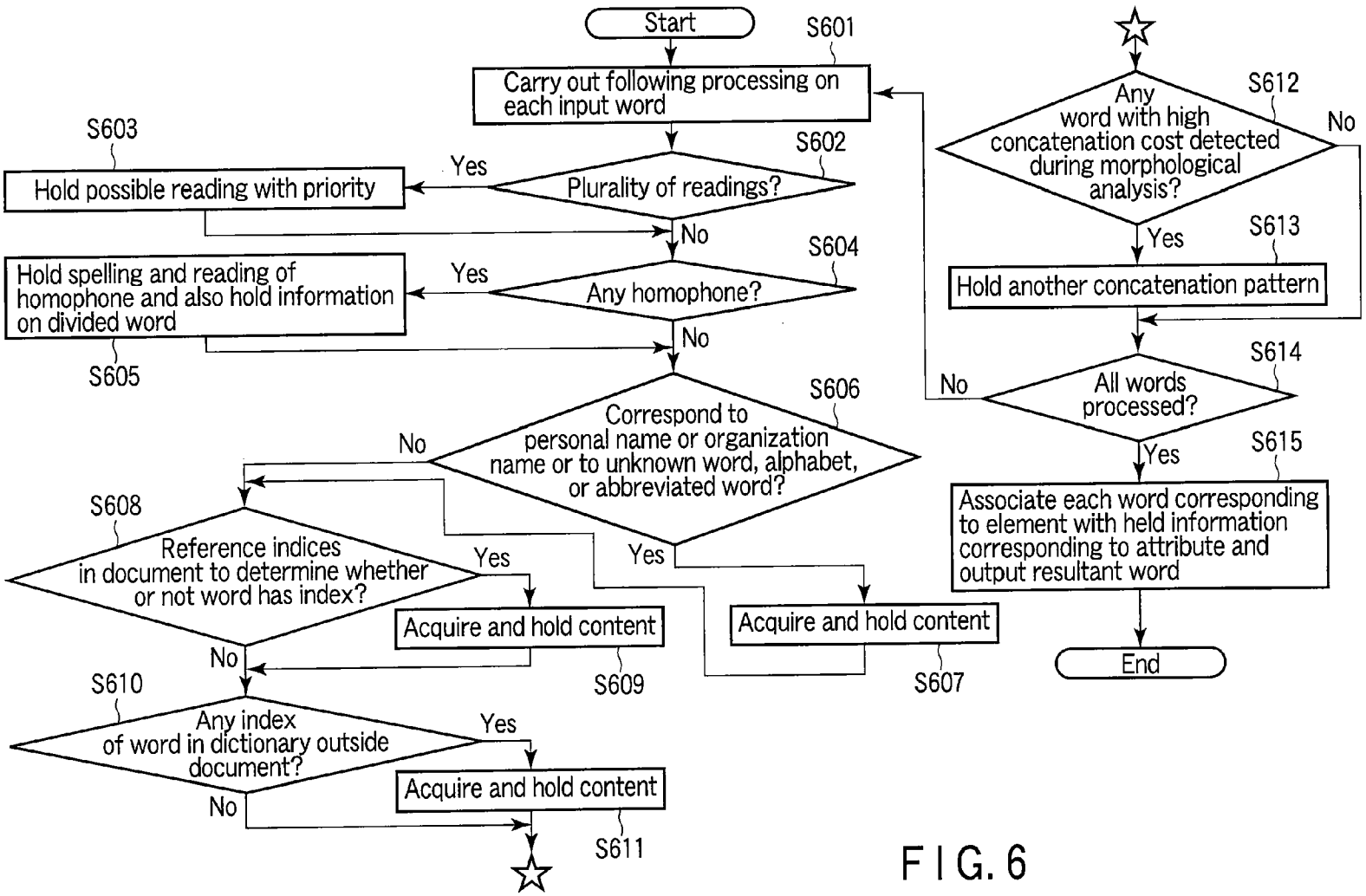
FIG. 6 is a flowchart illustrating the operations of a detailed attribute acquisition unit.

The operation of the detailed attribute acquisition unit 104 will be described with reference to a flowchart in FIG. 6.

In step S601, the detailed attribute acquisition unit 104 receives a candidate word information item for one candidate word.

In step S602, the detailed attribute acquisition unit 104 determines whether or not each candidate word has a plurality of readings. If the candidate word has a plurality of readings, the detailed attribute acquisition unit 104 proceeds to step S603. If the candidate word does not have a plurality of readings, that is, if the candidate word has only one reading, the detailed attribute acquisition unit 104 proceeds to step S604.

In step S603, those of the plurality of readings which are likely to be used are given a high priority and held. The priority may be set, for example, to have a smaller value when the corresponding reading is more likely to be used.

In step S604, the detailed attribute acquisition unit 104 determines whether or not the candidate word has any homophone. If the candidate word has any homophone, the detailed attribute acquisition unit 104 proceeds to step 605. If the candidate word has no homophone, the detailed attribute acquisition unit 104 proceeds to step 606.

In step S605, the detailed attribute acquisition unit 104 holds the spelling and reading of a present homophone. If the homophone forms a plurality of kanji characters, the detailed attribute acquisition unit 104 holds information on character strings into which the kanji characters are divided.

In step S606, the detailed attribute acquisition unit 104 determines whether or not the noun received in step S601 corresponds to any one of a personal name, an organization name, an unknown word, an alphabet, and an abbreviated name. If the noun corresponds to any one of these, the detailed attribute acquisition unit 104 proceeds to step S607. If the noun does not correspond to any of these, the detailed attribute acquisition unit 104 proceeds to step S608.

In step S607, the detailed attribute acquisition unit 104 acquires and holds the content corresponding to step S606. For example, if "ABC Co., Ltd." is an official name and the candidate word "ABC" is an abbreviated name, the detailed attribute acquisition unit 104 holds the official name "ABC Co., Ltd.".

In step S608, if an index information item has been created for the document containing the partial document, the detailed attribute acquisition unit 104 references the index information item to determine whether or not the corresponding candidate word has an index. The index information item refers to pre-created indices that are referenced for mechanical searches or browsing performed on the entire document. If the corresponding candidate word has an index, the detailed attribute acquisition unit 104 proceeds to step S609. If the corresponding candidate word has no index, the detailed attribute acquisition unit 104 proceeds to step S610.

In step S609, the detailed attribute acquisition unit 104 holds the index of the corresponding candidate word.

In step S610, the detailed attribute acquisition unit 104 determines whether or not the candidate word has its index in the external term dictionary 109. If the candidate word has an index in the term dictionary 109, the detailed attribute acquisition unit 104 proceeds to step S611. If the candidate word has no index in the term dictionary 109, the detailed attribute acquisition unit 104 proceeds to step S612.

In step S611, the detailed attribute acquisition unit 104 holds the index of the corresponding candidate word.

In step S612, the detailed attribute acquisition unit 104 determines whether or not any candidate word has a high concatenation cost in connection with the process for the morphological analysis. The concatenation cost is a value indicating the likelihood that words are connected together. For example, in a common context, it is likely that the word "姓 (sei) (family name)" is followed by the word "名 (mei) (first name)" so that the words are connected together into "姓名 (seimei)". In contrast, it is unlikely that the word "mei" is followed by the word "sei" so that the words are connected together into "名姓 (meisei)". Thus, an order of "sei" and "mei" have a high concatenation cost. If any word has a high concatenation cost, the detailed attribute acquisition unit 104 proceeds to step S613. If no word has a high concatenation cost, the detailed attribute acquisition unit 104 proceeds to step S614. The detailed attribute acquisition unit 104 may receive the concatenation cost from the morphological analysis dictionary 108 or receive, from the phrase extraction unit 103, the concatenation cost obtained through the morphological analysis performed by the phrase extraction unit 103.

In step S613, for the candidate word, the detailed attribute acquisition unit 104 holds other concatenation patterns, that is, other separation positions for a word class. Here, the detailed attribute acquisition unit 104 desirably holds all concatenation patterns.

In step S614, the detailed attribute acquisition unit 104 determines whether or not all the candidate words extracted by the phrase extraction unit 103 have been processed. If all the candidate words have been processed, the detailed attribute acquisition unit 104 proceeds to step S615. If not all the candidate words have been processed, the detailed attribute acquisition unit 104 returns to step S601 to perform the above-described process on the next candidate word in the above-described manner.

In step S615, the detailed attribute acquisition unit 104 associates the candidate word information items with the attribute information items held in the above-described steps to obtain detailed attribute information items. Thus, the detailed attribute acquisition unit 104 ends its process.

Now, an example of detailed attribute information items output by the detailed attribute acquisition unit 104 will be described with reference to FIG. 7.

The first to third columns correspond to the candidate word information items from the phrase extraction unit 103. The fourth to final columns relate to a concatenation cost 701, other readings 702, homophones 703, internal indices or an internal dictionary 704, and an external dictionary 705, respectively; a combination of these pieces of information corresponds to attribute information items 706. For example, for the word the ID 501 of which is (8), the morphological analysis results indicate that this word is a proper noun and that the reading of the word is "saegusa". However, the acquired results for attribute information items indicate that other reading candidates "mie" and "sanshi" are held. Furthermore, for the words the IDs 501 of which are (5) and (6), the morphological analysis results indicate that the readings of these words are "kuruma (car)" and "kocho (ride height)", respectively. If these words have a high concatenation cost, each of the words is marked.

Figure 8:
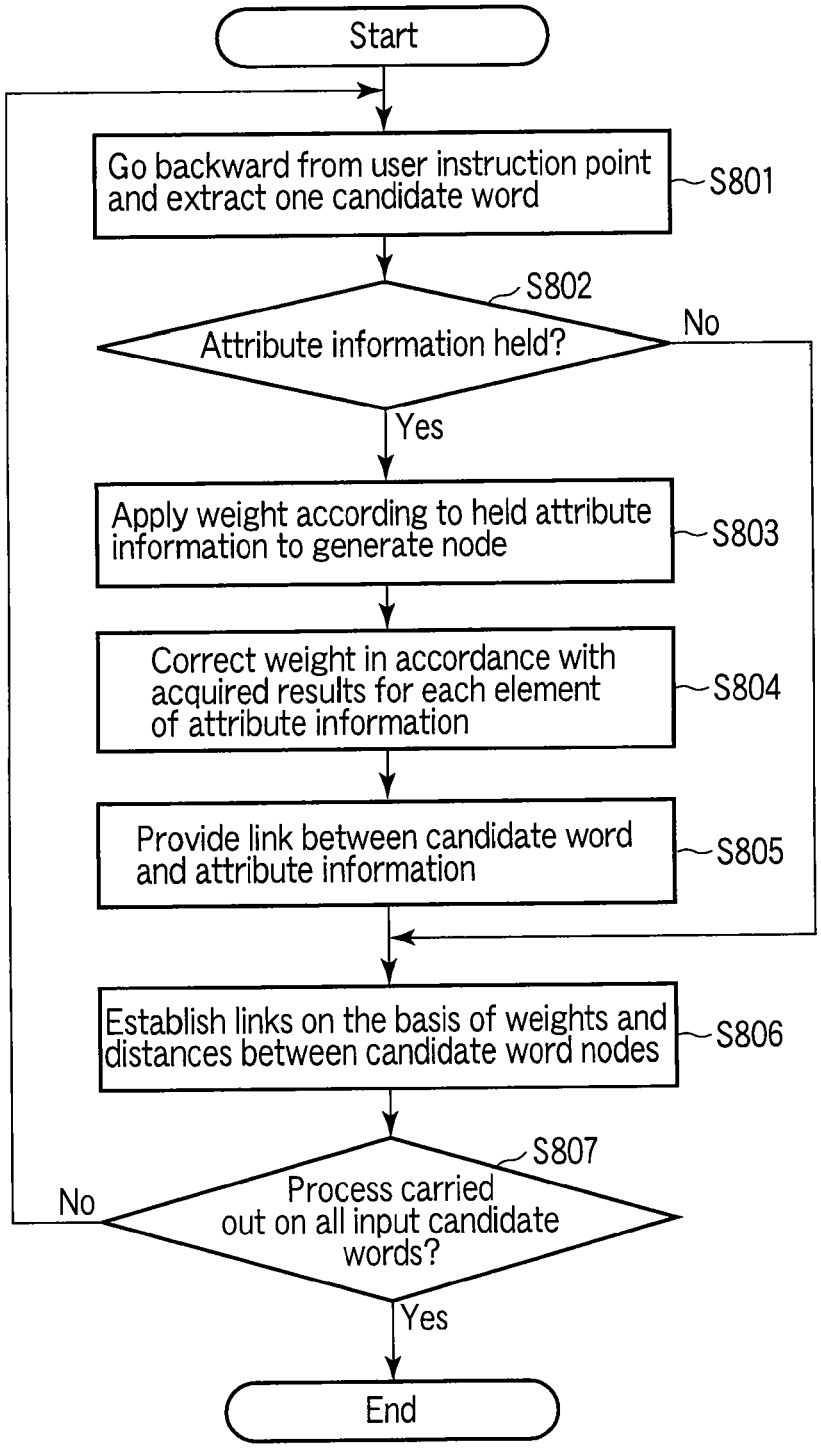
FIG. 8 is a flowchart illustrating the operation of a presentation candidate generation unit.

Next, the operation of the presentation candidate generation unit 105 will be described with reference to a flowchart in FIG. 8.

In step S801, the presentation candidate generation unit 105 extracts one candidate word. Here, the presentation candidate generation unit 105 extracts candidate words in order of increasing ID 501 shown in FIG. 7. That is, the presentation candidate generation unit 105 extracts the candidate words in a retrogressive order from the candidate word closest to the point of reception of an instruction signal for document re-reading to the candidate word farthest from the point of reception.

In step S802, the presentation candidate generation unit 105 determines whether or not any attribute information items is held for the extracted candidate word. If no attribute information items are held for the extracted candidate word, the presentation candidate generation unit 105 proceeds to step S805. If any attribute information items are held for the extracted candidate word, the presentation candidate generation unit 105 proceeds to step S803.

In step S803, the presentation candidate generation unit 105 weights the candidate word in accordance with the attribute information items to generate a node.

In step S804, in accordance with the acquired results for attribute information items, the presentation candidate generation unit 105 corrects the value weighted in step S803. The weight on the node in step S803 and step S804 can be calculated using:

$$W(n) = \frac{1}{d(n)} \sum_{i=0}^{k} w_i o_i. \tag{1}$$

Here, the node is denoted by n. Then, W(n) denotes a weighting value for the node n, and d(n) denotes the number of characters from the position of the word for which the user has given an instruction to the node n. This number of characters is hereinafter referred to as a distance. Furthermore, k denotes the number of all the types of attribute information items (the total number of elements), $W_i$ denotes a weighting coefficient associated with each the attribute information items, and $O_i$ denotes a value obtained by dividing the number of times that each of the attribute information items appears, by the number of all the elements appearing in connection with the node n (the number of all the candidates listed for the node n regardless of the type of the element). The weighting in this case uses a technique to fixedly provide a coefficient for word class information items for the candidate word corresponding to each node, or a coefficient for the number of elements of the attribute information items acquired, and the like. However, the present embodiment is not limited to this technique but may use, for example, a method of accumulating information from which the user can easily select, as a model, and weighting inputs with reference to the model.

In step S805, the presentation candidate generation unit 105 provides links between the candidate word and the type of attribute information in accordance with the acquired results for attribute information.

In step S806, the presentation candidate generation unit 105 establishes links from a base point taking into account the weight and the distance of each candidate node. The weighting between the nodes may be calculated using:

$$s(p, q) = \frac{W(p)W(q)}{d(p)d(q)}. \tag{2}$$

Here, s(p, q) denotes the weighting between a node p and a node q, W(p) and W(q) denote the weights on the node p and the node q, respectively, and d(p) and d(q) denote the distances of the node p and the node q, respectively. In general, the weight increases with decreasing distance.

In step S807, the presentation candidate generation unit 105 determines whether or not all the candidate words have been processed. If not all the candidate words have been processed, the presentation candidate generation unit 105 returns to step S801 to repeat a similar process. If all the candidate words have been processed, the presentation candidate generation unit 105 ends the process.

Now, an example of the results of processing carried out by the presentation candidate generation unit 105 will be described with reference to FIG. 9 and FIG. 10.

Figure 9:
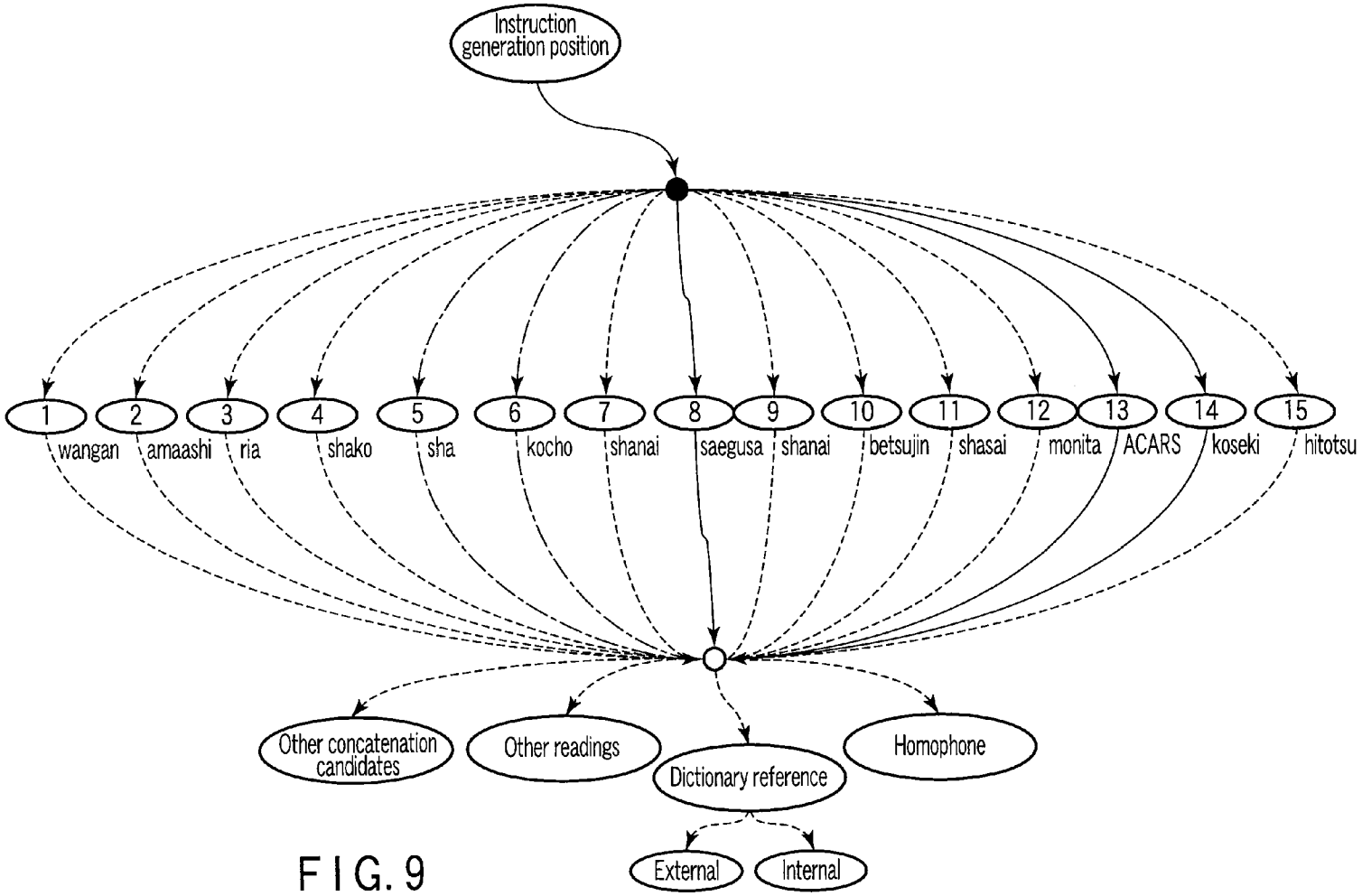
FIG. 9 illustrates an example of the order of presentation of candidate words displayed as nodes.
Figure 10:
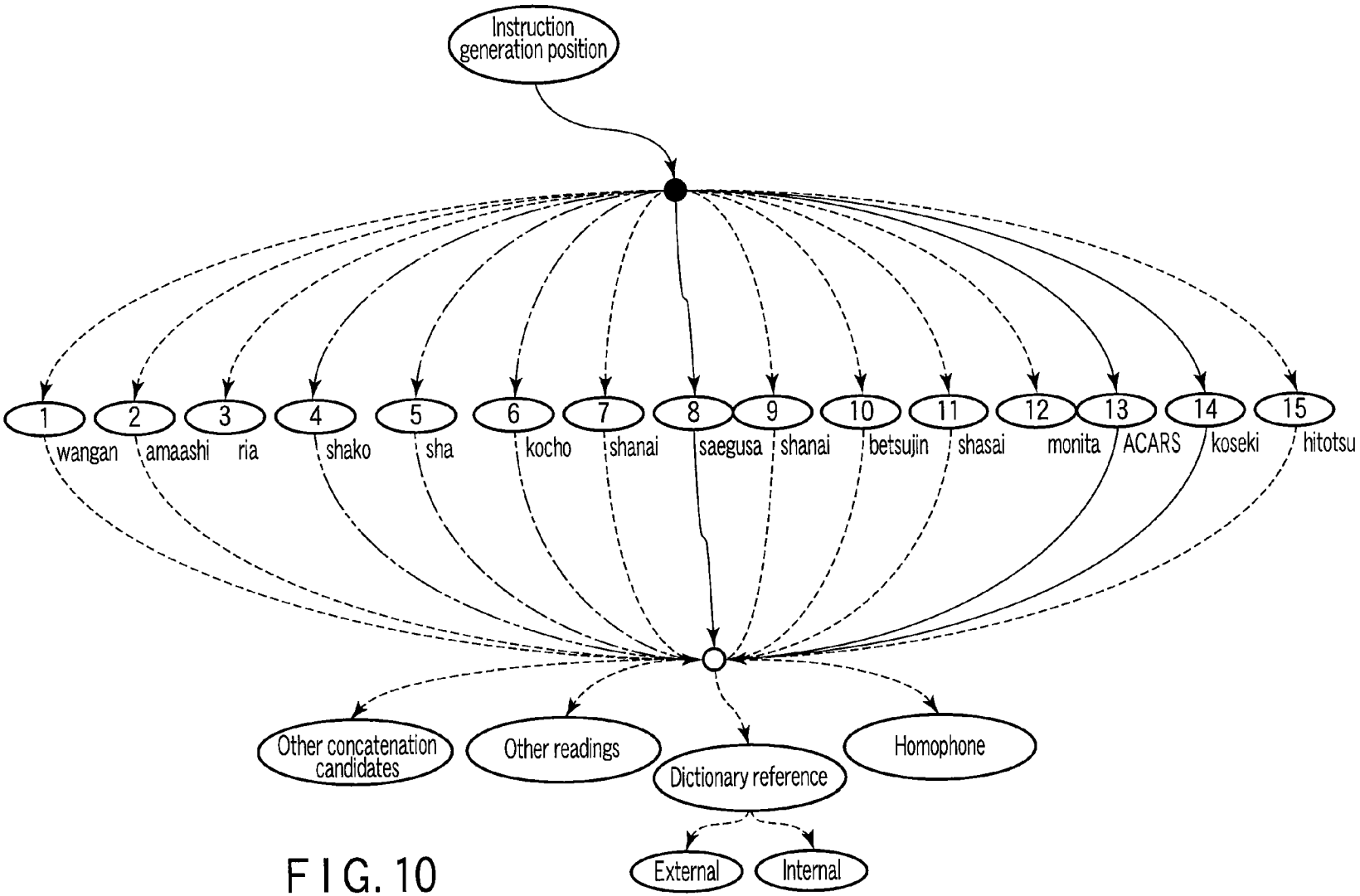
FIG. 10 illustrates an example of the order of presentation of candidate words displayed as nodes.

FIG. 9 and FIG. 10 show how links are provided to the candidate words, with the point where the user gives an instruction, specified as a start point node. Links are also provided which join the respective words to the attribute information items on the words.

In the example illustrated in FIG. 9, the weighting on links to ID (14), ID (13) and ID (8) shown by solid lines indicates that these links, which have a higher weight, are more important than the other links shown by dotted lines. The importance in the weighting determines the order of presentation for re-reading of the document.

Furthermore, ID (6) and ID (5) have another possibility of concatenation and are thus shown by a different type of link (here an alternate long and short dash line). For ID (6) and ID (5), if in addition to the current separation of a word class "車高調 (sha/kocho)", another type with no separation, that is, "車高調(shakocho)(ride height control), is present, the attribute information item "other concatenation candidates" may be held.

FIG. 10 shows other results of processing performed by the presentation candidate generation unit 105. In the example illustrated in FIG. 10, if there is a link to any attributes information items, the corresponding attribute information items is described. If there is no link to attribute information items, the attribute information items is not described. As shown in the detailed attribute information items in FIG. 7, "ria (rear)" and "monita (monitor)" have no attribute information items and thus no link to the attribute information items.

Figure 11:
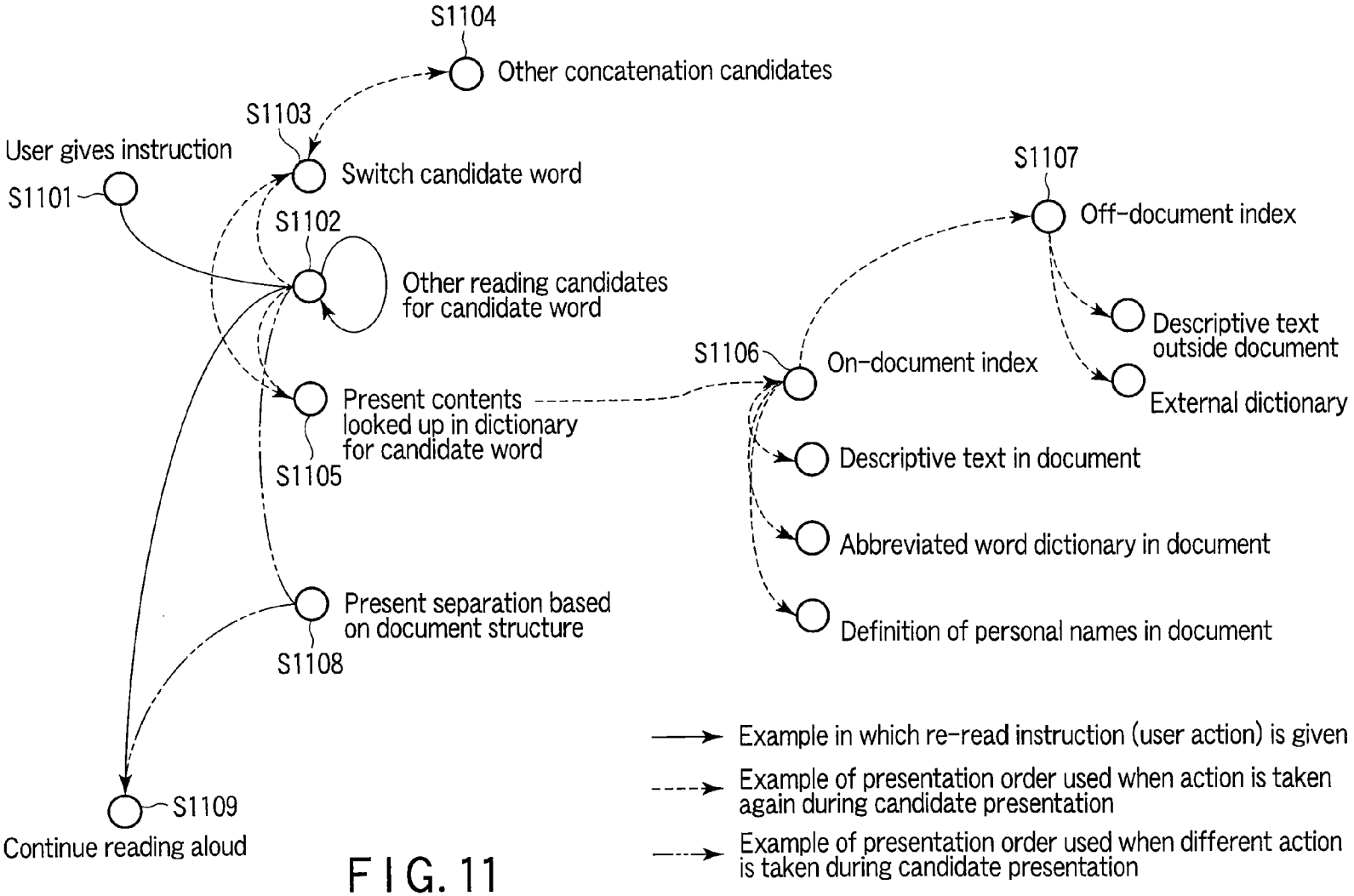
FIG. 11 is a transition diagram illustrating an example of the presentation order.

FIG. 11 shows an example of the order of presentation of words performed by the candidate presentation unit 106.

In step S1101, the user gives an instruction. In the description below, it is assumed that the user gives an instruction at the position (B) shown in FIG. 2, that is, the position where reading aloud of the word "は (wa)" is finished.

In step S1102, the candidate presentation unit 106 presents other reading candidates for the candidate word in order of increasing weight, that is, increasing importance. For example, the reading candidates are presented like "saegusa, mie, sanshi". The other reading candidates for the candidate word may be automatically presented in order of increasing importance or may be presented in accordance with the user's instruction. For example, if the user gives an instruction (first instruction) when another reading candidate is presented, the candidate presentation unit 106 may present the next reading candidate. If the user gives no instruction, the candidate presentation unit 106 determines that the user has confirmed the currently presented reading candidate. The candidate presentation unit 106 then shifts to step S1109 to continue reading aloud the document. Furthermore, the user gives an instruction (second instruction) different from the one to allow the candidate presentation unit 106 to present the next reading candidate, to shift to switching of the candidate (step S1103) or presentation of contents looked up in the dictionary for the object word (step S1105).

In step S1103, the candidate presentation unit 106 switches the candidate word. For example, the candidate presentation unit 106 switches among "航跡 (koseki)", "ACAR", and "wangan". Alternatively, the user may give the second instruction to present other concatenation candidates (step S1104) or to present contents looked up in the dictionary for the candidate word (step S1105).

In step S1104, the candidate presentation unit 106 presents other concatenation candidates.

In step S1105, the candidate presentation unit 106 shifts to step S1106 or step S1107 in order to present contents looked up in the dictionary for the candidate word.

In step S1106, the candidate presentation unit 106 presents descriptive text in the document, an abbreviated word dictionary in the document, the definition of personal names in the document, and the like which are each of attribute information items acquired from on-document indices.

In step S1107, the candidate presentation unit 106 presents descriptive text outside the document, an external dictionary, and the like which are each of attribute information items acquired from off-document indices.

Furthermore, in step S1102, upon further receiving a different user instruction (third instruction) different from the second instruction from user, the candidate presentation unit 106 shifts to step S1108. The third instruction herein indicates that for example, for the second instruction, the user presses a button on an earphone remote controller once, whereas for the third instruction, the user presses the button twice in a row. Similarly, the third instruction indicates that if for the second instruction, the user shakes the reading aloud terminal once, then for the third instruction, the user shakes the reading aloud terminal twice.

In step S1108, the candidate presentation unit 106 presents separation based on the structure of the document. Furthermore, in step S1108, if the second instruction is received or a given time has elapsed without any user action, reading aloud is continued (step S1109).

Additionally, when the candidate word is switched, the presentation candidate generation unit 105 may automatically perform such an operation as follows: if any detailed candidate information items are available, the presentation candidate generation unit 105 presents the next candidate for the same phrase, and if no detailed candidate information items are available, the presentation candidate generation unit 105 presents attribute information items on another candidate word. In addition, if no candidate word is available, the following may be performed: an operation of re-reading the extracted partial document from the beginning, starting re-reading from the preceding paragraph or sentence, or going backward through the partial document by a fixed portion of the elapsed time, that is, for example, the presentation candidate generation unit 105 may perform going backward between a beginning few seconds of elapsed time.

Figure 12:
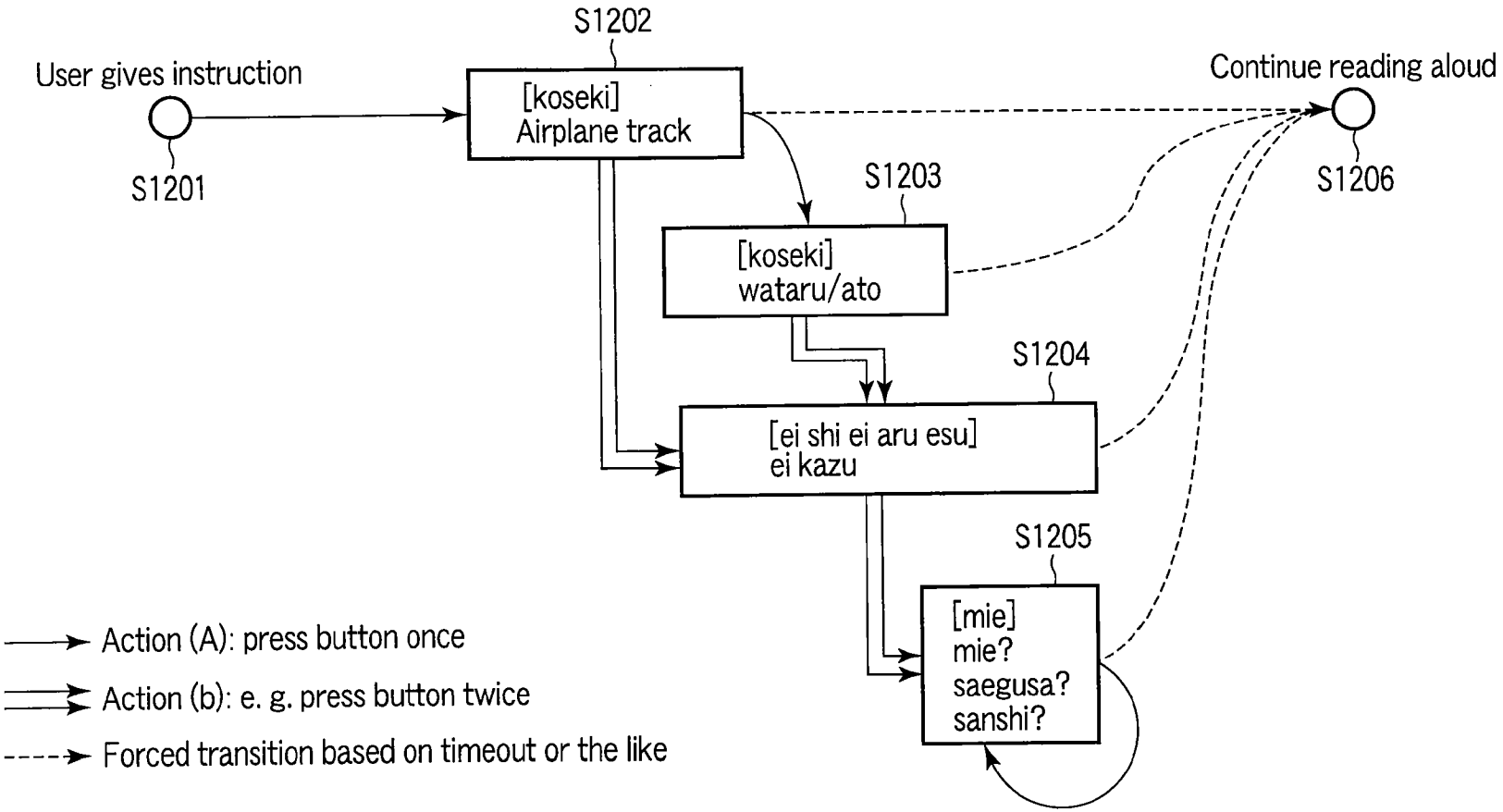
FIG. 12 is a transition diagram illustrating a specific example of the presentation order.

Now, a specific example of the operation of the reading aloud support apparatus 100 according to the present embodiment will be described with reference to FIG. 12.

In step S1201, the user gives an instruction. Here, "koseki" in the document is a candidate word.

In step S1202, the reading aloud support apparatus 100 presents the meaning of "koseki" "airplane track" by determining that in this case, presentation of other readings is a lower weight. Upon understanding the output meaning, the user stands by without performing any operation or performs a specified operation. Then, the reading aloud support apparatus 100 shifts to step S1206 to continue reading aloud. On the other hand, if the user gives the third instruction (for example, the user presses the button twice or shakes the terminal twice) during the presentation of meaning of "koseki", the reading aloud support apparatus 100 shifts to step S1203.

In step S1203, the reading aloud support apparatus 100 presents the reading "wataru/ato" obtained by separating the two kanji characters from each other, as another type of information on the same phrase "koseki".

If in step S1203, the user similarly gives the third instruction, the reading aloud support apparatus 100 presents the next phrase "ACARS". For alphabets, the reading aloud support apparatus 100 can support communication of the correct information to the user in spite of possible erroneous reading, by outputting reading corresponding to the relevant language or outputting the reading of each spelling. Here, "ei kazu" or "ei shi ei aru esu" is output by a voice. Furthermore, if the user gives no instruction, the reading aloud support apparatus 100 shifts to step S1206 to continue re-reading. If the user gives the third instruction, the reading aloud support apparatus 100 goes backward to the phrase preceding the current one and then shifts to step S1205.

In step S1205, the reading aloud support apparatus 100 provides a plurality of alternate readings of "saegusa", and presents the candidates "mie", "saegusa", and "sanshi" in order. If the user cannot understand the meaning of the utterance "saegusa" within the context of the content, the user gives the first instruction to allow the reading aloud support apparatus 100 to provide another reading candidate. If the user fully understands the presented candidate, the reading aloud support apparatus 100 determines that the user has confirmed this reading candidate. The reading aloud support apparatus 100 thus shifts to step S1206 to continue reading aloud. Specifically, if for example, the user determines the reading of the phrase to be "mie" instead of "saegusa", reading aloud starts to be continued after no instruction has been given for a given period. In this case, the priority of the reading may be changed such that if "saegusa" appears during the subsequent reading aloud of the document, "mie" is read aloud. Moreover, the correspondences between the instructions (actions) and the presented candidate words are not fixed but may be freely customized by the user. Alternatively, if any particular candidate word is present, the candidate word may be preferentially output, or in contrast, a particular candidate word may be prevented from being output.

According to the present embodiment described above, the degree of freedom of the re-read position can be increased by selecting a candidate word to be re-read based on the word class. Moreover, in this case, candidate words and attribute information items on the candidate words are presented with required information supplemented. Then, when the user takes a simple action of selecting a candidate word or letting the reading aloud pass, the document can be re-read based on expanded information rather than being simply re-read by setting the reading aloud position back to a point in time that is earlier by a given period of time. Thus, the user's understanding can be supported.

Modification of the Embodiment

The present modification is different from the present embodiment in that the order of presentation of candidate words and the attribute information items on the candidate words to be presented are changed by referencing a model that corresponds the presentation order of the candidate words and attribute information items on the candidate words based on the content and type of the document.

Figure 13:
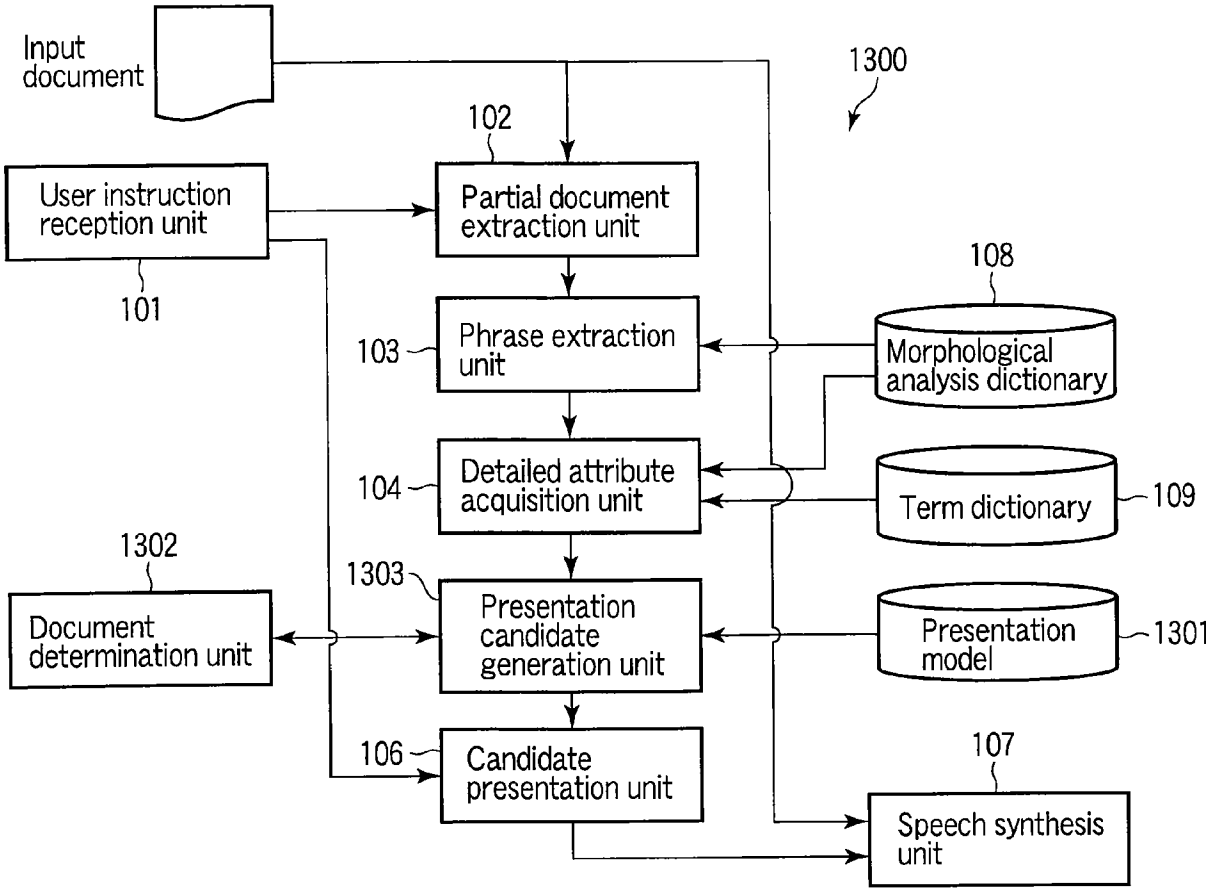
FIG. 13 is a block diagram illustrating a reading aloud support apparatus according to a modification of the present embodiment.

A reading aloud support apparatus according to a modification of the present embodiment will be described with reference to a block diagram in FIG. 13.

The reading aloud support apparatus 1300 according to the modification of the present embodiment includes a user instruction reception unit 101, a partial document extraction unit 102, a phrase extraction unit 103, a detailed attribute acquisition unit 104, a presentation candidate generation unit 1303, a candidate presentation unit 106, a speech synthesis unit 107, a morphological analysis dictionary 108, a term dictionary 109, a presentation model 1301, and a document determination unit 1302.

The following operate as is the case with the present embodiment: the user instruction reception unit 101, the partial document extraction unit 102, the phrase extraction unit 103, the detailed attribute acquisition unit 104, the candidate presentation unit 106, the speech synthesis unit 107, the morphological analysis dictionary 108, and the term dictionary 109. Thus, these units will not be described below.

The presentation model 1301 is configured to store individual user profiles and to store models in which the common order of presentation of phrases and common weighting on the phrases are defined. The presentation model 1301 may be configured to store models in which the order of presentation of candidate words corresponding to the type of the document and attribute information items on the candidate words are associated with each other. For example, if the content of the document relates to sports, the weighting is determined such that the candidate words shown in the order of presentation are presented in order starting with terms about sports. Moreover, in the models, the weighting may be determined such that as attribute information items on the candidate words (terms about sports), each of attribute information items such as team information which are obtained with reference to an external dictionary are preferentially presented instead of readings or homophones.

The document determination unit 1302 receives detailed attribute information items from the presentation candidate generation unit 1303 to present the results of determination of the content and type of the document being read aloud which results are included in the detailed attribute information items. Alternatively, the document determination unit 1302 may directly receive an input document and determine the content and type of the document with reference to information such as a genre associated with the input document, though this is not shown in the drawings.

The presentation candidate generation unit 1303 performs an operation almost similar to that of the presentation candidate generation unit 105 according to the present embodiment. The presentation candidate generation unit 1303 receives detailed attributed information items from the detailed attribute acquisition unit 104, the determination results from the document determination unit 1302, and the models from the presentation model 1301, respectively. The presentation candidate generation unit 105 then changes the presentation order and the order of presentation of each of the attribute information items by changing the weighting on the presentation order and the each of the attribute information items with reference to the model corresponding to the determination results.

According to the modification of the present embodiment described above, the candidate words suitable for the document and the corresponding attribute information items can be presented by changing the weighting on the presentation order and the elements of the attribute information items depending on the contents and type of the documents. Thus, re-reading can be achieved with the user's understanding more appropriately supported.

The flow charts of the embodiments illustrate methods and systems according to the embodiments. It will be understood that each block of the flowchart illustrations, and combinations of blocks in the flowchart illustrations, can be implemented by computer program instructions. These computer program instructions may be loaded onto a computer or other programmable apparatus to produce a machine, such that the instructions which execute on the computer or other programmable apparatus create means for implementing the functions specified in the flowchart block or blocks. These computer program instructions may also be stored in a non-transitory computer-readable memory that can direct a computer or other programmable apparatus to function in a particular manner, such that the instruction stored in the non-transitory computer-readable memory produce an article of manufacture including instruction means which implement the function specified in the flowchart block or blocks. The computer program instructions may also be loaded onto a computer or other programmable apparatus to cause a series of operational steps to be performed on the computer or other programmable apparatus to produce a computer programmable apparatus which provides steps for implementing the functions specified in the flowchart block or blocks.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A reading aloud support apparatus for supporting a speech synthesis device performing to read aloud a character string in a document as a voice, comprising:

a reception unit configured to receive an instruction from a user to generate an instruction signal;

a first extraction unit configured to extract, as a partial document, a part of the document which corresponds to a range of words including a first word and one or more second words preceding the first word, if the instruction signal is received while the speech synthesis device performs to read aloud the first word of the document;

a second extraction unit configured to perform morphological analysis on a sentence included in the partial document and to extract one or more words as one or more candidate words, the candidate words which belong to a word class corresponding to target start positions for re-reading of the partial document;

an acquisition unit configured to acquire, for each of the candidate words, attribute information items relating to the candidate words, the attribute information items including reading candidates;

a generation unit configured to perform, for each of the candidate words, weighting relating to a value corresponding a distance, the distance indicating a number of characters between each of the candidate words and the first word, to determine each of the candidate words to be preferentially presented based on the weighting, and to generate a presentation order; and a speech synthesis unit configured to present the candidate words and the attribute information items corresponding to the candidate words as a voice in accordance with the presentation order.

2. The apparatus according to claim 1, wherein the acquisition unit acquires, as the attribute information items, a plurality of reading candidates for the candidate words and at least one homophone of the candidate words, and also acquires a personal name of the candidate words or a formal name of the candidate words from at least one of an internal documents and an external documents.

3. The apparatus according to claim 1, wherein the generation unit changes a priority of reading of the candidate words when the speech synthesis device performs to read aloud of the document in accordance with a result of selection from the reading candidates by the user.

4. The apparatus according to claim 2, wherein the presentation unit presents a next reading candidate for a first candidate word of the candidate words if the user gives a first instruction during presentation of the first candidate word, presents a second candidate word of the candidate words if the user gives a second instruction, and presents an element different from the attribute information items for the first candidate word being presented if the user gives a third instruction.

5. The apparatus according to claim 1, further comprising a determination unit configured to determine a type of the document to obtain a determination result, and wherein the generation unit changes the presentation order of the candidate words and the presentation order of the attribute information items for the candidate words, with reference to the determination result and a model in which associates the presentation order of the candidate words corresponding to the type of the document with the attribute information items on the candidate words.

6. The apparatus according to claim 1, wherein the generation unit further performs weighting on each of the candidate words using a number of acquired the attribute information items and a weighting coefficient for each of the attribute information items, and sets that weights on each of the candidate words increases with decreasing the distance of each the candidate words.

7. A reading aloud support method for supporting a speech synthesis device performing to read aloud a character string in a document as a voice, comprising receiving, at a computer or other programmable apparatus, an instruction from a user to generate an instruction signal;

extracting, via the computer or other programmable apparatus, as a partial document, a part of the document which corresponds to a range of words including a first word and one or more second words preceding the first word, if the instruction signal is received while the speech synthesis device performs to read aloud the first word of the document;

performing, via the computer or other programmable apparatus, morphological analysis on a sentence included in the partial document and extracting one or more words as one or more candidate words, the candidate words which belong to a word class corresponding to a target start positions for re-reading of the partial document;

acquiring, via the computer or other programmable apparatus, for each of the candidate words, attribute information items relating to the candidate words, the attribute information items including reading candidates;

performing, via the computer or other programmable apparatus, for each of the candidate words, weighting relating to a value corresponding a distance, the distance indicating a number of characters between each of the candidate words and the first word, and determining each of the candidate words to be preferentially presented based on the weighting to generate a presentation order; and presenting, as the voice, using the computer or other programmable apparatus, the candidate words and the attribute information items corresponding to the candidate words in accordance with the presentation order.

8. A non-transitory computer readable medium including computer executable instructions, wherein the instructions, when executed by a processor, cause the processor to perform a method comprising:

receiving an instruction from a user to generate an instruction signal;

extracting, as a partial document, a part of the document which corresponds to a range of words including a first word and one or more second words preceding the first word, if the instruction signal is received while the speech synthesis device performs to read aloud the first word of the document;

performing morphological analysis on a sentence included in the partial document and extracting one or more words as one or more candidate words, the candidate words which belong to a word class corresponding to a target start positions for re-reading of the partial document;

acquiring, for each of the candidate words, attribute information items relating to the candidate words, the attribute information items including reading candidates;

performing, for each of the candidate words, weighting relating to a value corresponding a distance, the distance indicating a number of characters between each of the candidate words and the first word, and determining each of the candidate word to be preferentially presented based on the weighting to generate a presentation order; and presenting the candidate words and the attribute information items corresponding to the candidate words as a voice in accordance with the presentation order.

* * * * *